US005749447A

United States Patent [19]

Hersh et al.

[11] Patent Number: 5,749,447

[45] Date of Patent: May 12, 1998

[54] HANDBAG HAVING COMPARTMENTALIZED STORAGE AREA

[75] Inventors: Ahron Hersh, Brooklyn, N.Y.; Chi Yueh Chen, Taipei, Taiwan

[73] Assignee: Rosetti Handbags and Accessories Ltd., New York, N.Y.

[21] Appl. No.: 504,995

[22] Filed: Jul. 20, 1995

[51] Int. Cl.[6] ..... A45C 3/06

[52] U.S. Cl. ..... 190/112; 190/111

[58] Field of Search ..... 150/110, 111, 150/112, 117; 190/110, 111, 112, 109; 383/41, 40, 38

[56] References Cited

U.S. PATENT DOCUMENTS

| | | | |
|---|---|---|---|
| 1,790,497 | 1/1931 | Brady . | |
| 2,331,428 | 10/1943 | Selezneff . | |
| 2,665,728 | 1/1954 | Hyman . | |
| 2,705,989 | 4/1955 | Gusmarino . | |
| 2,717,015 | 9/1955 | Berry | 190/110 X |
| 2,855,969 | 10/1958 | Shields . | |
| 4,171,011 | 10/1979 | Kopin | 150/117 |
| 4,236,615 | 12/1980 | Ginat | 190/111 |
| 4,301,849 | 11/1981 | Litwack et al. | 150/117 X |
| 4,378,866 | 4/1983 | Pelavin | 190/111 |
| 4,739,809 | 4/1988 | Adams | 150/117 X |
| 4,805,749 | 2/1989 | Gecch | 150/117 X |
| 4,995,436 | 2/1991 | Cantor . | |
| 5,265,719 | 11/1993 | Wand | 190/111 X |

*Primary Examiner*—Stephen P. Garbe
*Assistant Examiner*—Christopher J. McDonald
*Attorney, Agent, or Firm*—Abelman, Frayne & Schwab

[57] ABSTRACT

A handbag is disclosed which includes an enclosure having opposed front and rear walls, opposed side walls, a bottom wall, and an opening defined opposite the bottom wall for gaining access into an interior area of the enclosure. The interior area of the enclosure is subdivided into first and second incommunicable storage regions separated from one another by a curtain wall. The first storage region is accessible through the opening of the handbag, and the second storage region is accessible through a structural portal formed in the front wall of the handbag.

24 Claims, 9 Drawing Sheets

FIG. 10
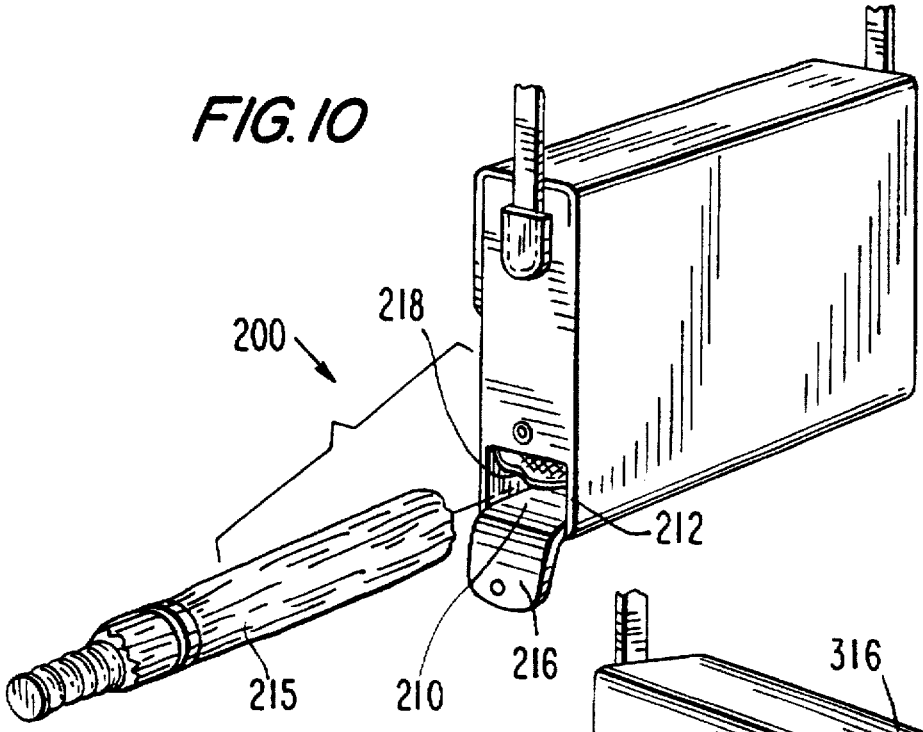
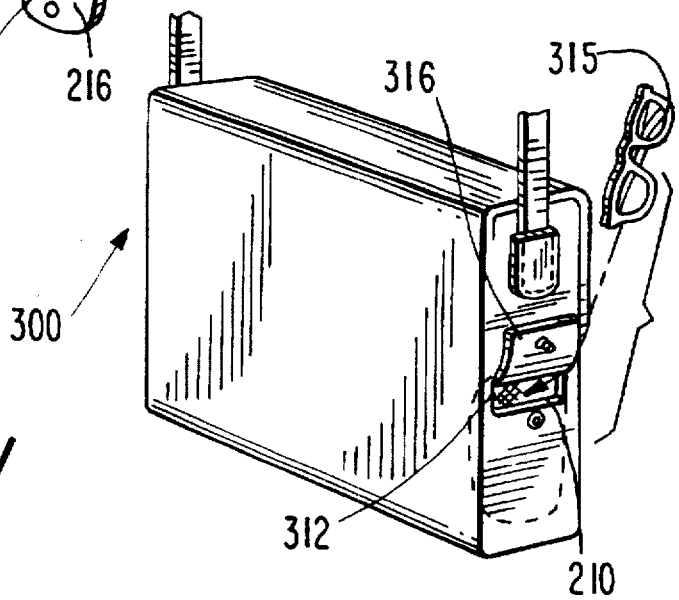
FIG. 11

FIG. 12
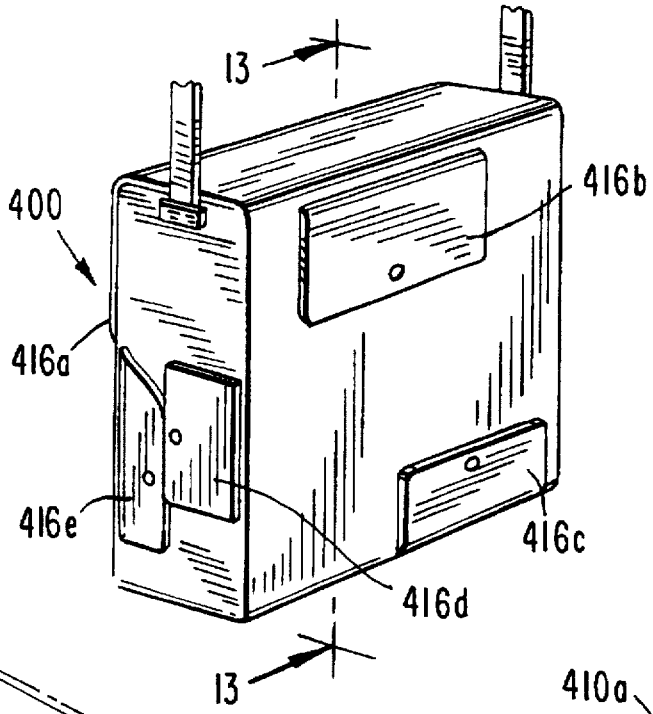
FIG. 13
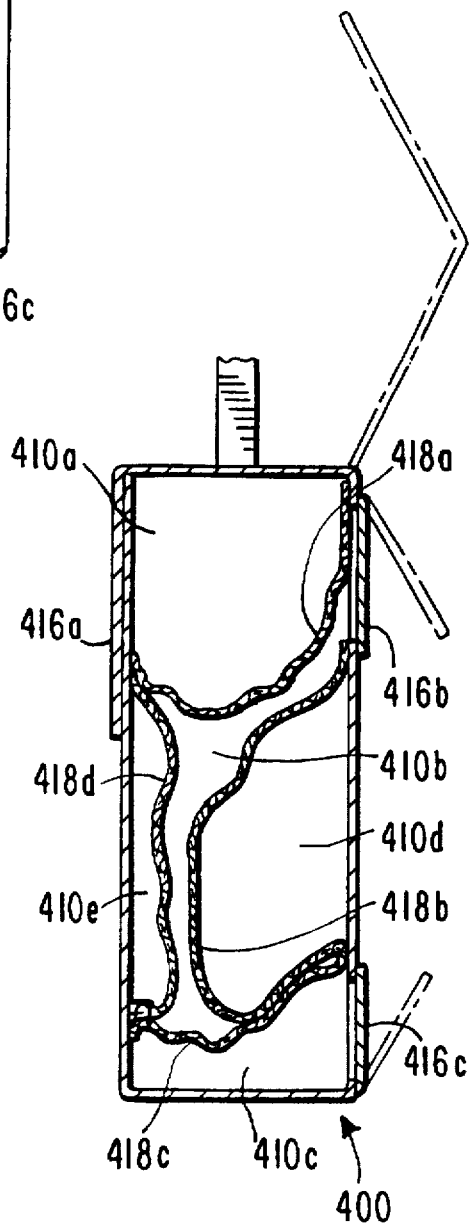
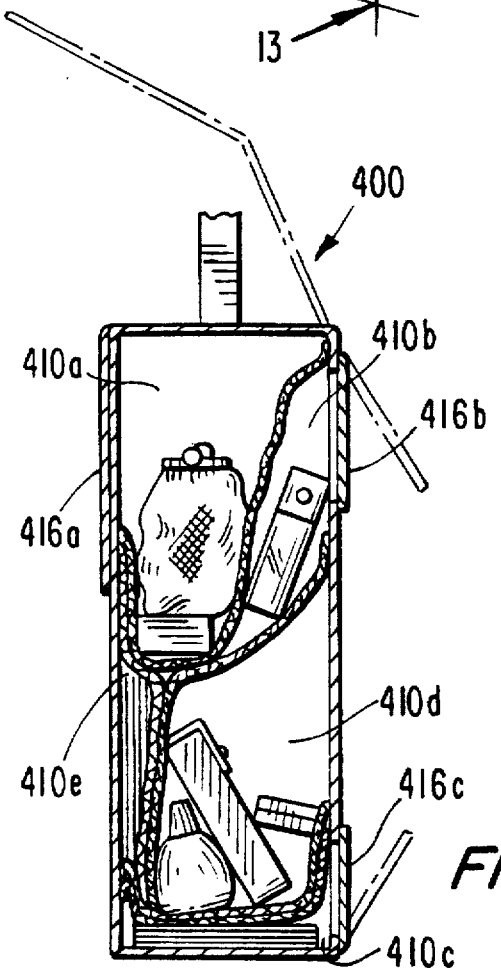
FIG. 14

HANDBAG HAVING COMPARTMENTALIZED STORAGE AREA

BACKGROUND OF THE INVENTION

1. Field of the Invention

This invention relates to handbags and other portable personal carrying containers, and more particularly, to a handbag having separate and distinct interior storage areas which are individually accessible through respective structured external entryways.

2. Description of the Related Art

The structure and usage of handbags, pocketbooks and other portable personal carrying containers is well known. Handbags and personal luggage are commonly constructed with one or more interior compartments configured to retain cosmetics, toiletries, and other items for ready access by the user. In all of these, however, access into the interior compartments is provided through the primary entryway of the container.

In handbags, for example, this primary entryway is at the top of the container and all access to the various interior compartments is through this one opening. Furthermore, all of the interior compartments are divided into vertical pockets of varying depth which are each accessed from the top through the primary opening. The disadvantages of this configuration becomes obvious when one considers the fact that smaller items such as cosmetics, keys, change and writing implements, which are most often used, tend to remain at the bottom of the vertical compartments.

One example of an early handbag in which an expansive interior storage area is provided is disclosed in U.S. Pat. No. 2,665,728 to Hyman. In such a handbag, items are often distributed randomly throughout the interior compartment, making quick access to any specifically desired item or items somewhat difficult.

Handbags constructed with separated compartments are also known. In such handbags, individual items can be stored in specific areas to make particularly desirable items more accessible than others. For example, U.S. Pat. No. 1,790,497 to Brady discloses a pocketbook having a central compartment and two hinged side panels having pockets for storing selected items in an accessible manner. Again, access is through the main opening and the interior structure is substantially vertical in configuration.

It would be desirable to provide a handbag or other personal carrying container, wherein the interior storage area is divided into several different organized interior storage regions in which selected items may be separately retained in a readily accessible manner. With such structure the items may be retrieved without the necessity of entering the main access opening of the handbag.

It would also be desirable to provide a handbag or luggage piece with structure for dividing and organizing the interior spaces such that often used and/or small items are prevented from migrating to the bottom of the handbag. Instead, such items may be readily accessed through independently securable structured openings which are conveniently located on the exterior of the container.

Additionally, a handbag can be constructedly wherein at least one of the storage areas is concealed or hidden from persons other than the user of the handbag so that items of value may be secreted therein. The present invention relates to handbags and other personal portable carrying containers having such features and advantages.

SUMMARY OF THE INVENTION

The subject invention is directed to a unique handbag or pocketbook which includes an enclosure having opposed front and rear walls, opposed side walls, a bottom wall, and an opening for gaining access into an interior area of the enclosure. The interior area of the enclosure is divided into first and second storage regions which are separated from one another by a fabric curtain wall. The curtain wall preferably extends from an upper edge portion of the front wall to a lower edge portion of the rear wall within the interior area of the enclosure, and may be loosely secured and dimensioned to permit selective expansion and reduction of either storage region in dependence upon the shape and/or dimension of the objects contained therein. The first storage region is accessible through the opening of the handbag, and the second storage region is accessible through a portal formed in the front wall of the handbag.

The handbag further includes a hinged closure panel which is operatively associated with the front wall of the handbag for covering the portal. The closure panel is adapted for securement in a closed position by a releasable fastening mechanism. A hinged access panel is preferably supported adjacent the closure panel and is mounted for selective movement between a closed position wherein the portal is concealed and an open position wherein access to the second storage region is facilitated. A releasable securement mechanism is associated with an exterior surface of the access panel to selectively maintain the access panel in a closed position.

A hinged closure flap is associated with an upper edge of the rear wall for selectively covering the opening of the handbag. The closure flap is secured in a closed position by a releasable fastening mechanism which is associated with the closure panel. A second hinged closure panel may be operatively associated with the rear wall of the handbag, and would be adapted for selective securement in a closed positioned by a releasable fastening mechanism.

A fabric liner preferably occupies a substantial portion of the second storage region to support objects introduced into the handbag through the portal. In addition, a plurality of storage pockets are preferably defined on an interior surface of the closure panel to support objects for easy access, and such pockets are also preferably defined on the interior and exterior surfaces of the access panel.

Additional embodiments of the handbag of the subject invention have an interior storage area which is divided into a plurality of storage compartments. Each compartment is individually accessible through a respective structured portal or entryway defined in one of the walls of the handbag.

These and other features of the handbag of the subject invention will become more readily apparent from the following detailed description of the invention taken in conjunction with the drawings.

BRIEF DESCRIPTION OF THE DRAWINGS

So that one skilled in the art to which the subject invention appertains will better understand how to make and use the handbag disclosed herein, preferred embodiments thereof will be described hereinbelow with reference to the drawings wherein:

FIG. 10 is a perspective view of a handbag constructed in accordance with a preferred embodiment of the subject invention and which includes a separate side access compartment for storing an elongated object such as an umbrella;

FIG. 11 is a perspective view of a handbag constructed in accordance with a preferred embodiment of the subject invention and which includes a separate side access compartment for storing small often used items such as a pair of eyeglasses;

FIG. 12 is a perspective view of a handbag constructed in accordance with a preferred embodiment of the subject invention which includes a plurality of separate storage compartments defined therein, each of which is accessible through different external entryway;

FIG. 13 is a cross-sectional view taken along lines 13—13 of FIG. 12 illustrating the storage compartments in an unloaded or empty condition; and FIG. 14 is a cross-sectional view taken along lines 13—13 of FIG. 12 illustrating the storage compartments in a partially loaded condition.

DETAILED DESCRIPTION OF THE PREFERRED EMBODIMENTS

Figure 1:
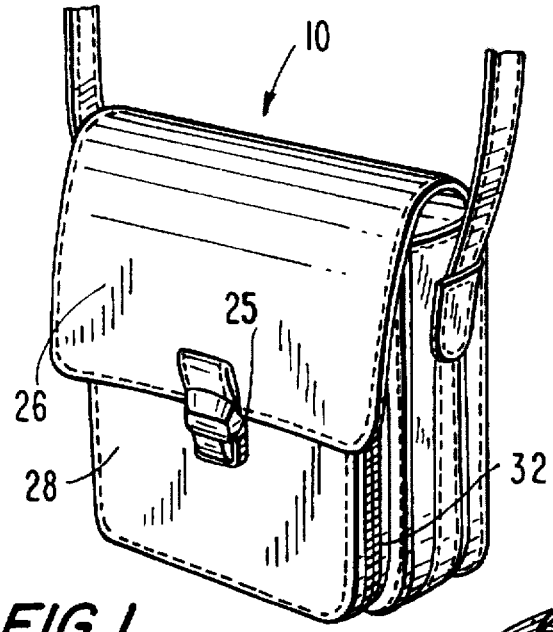
FIG. 1 is a perspective view of a handbag constructed in accordance with a preferred embodiment of the subject invention.

Referring now in detail to the drawings wherein like reference numerals identify similar structural elements of the invention disclosed herein, there is illustrated in FIG. 1 a handbag constructed in accordance with a preferred embodiment of the subject invention and designated generally by reference numeral 10. The construction of handbag 10 is unique among handbags known in the art in that its interior storage space is divided into two separate storage regions, each of which is accessible through a different entryway, one of which is normally concealed from persons other than the user of the handbag so that items of value may be secreted therein.

Figure 2:
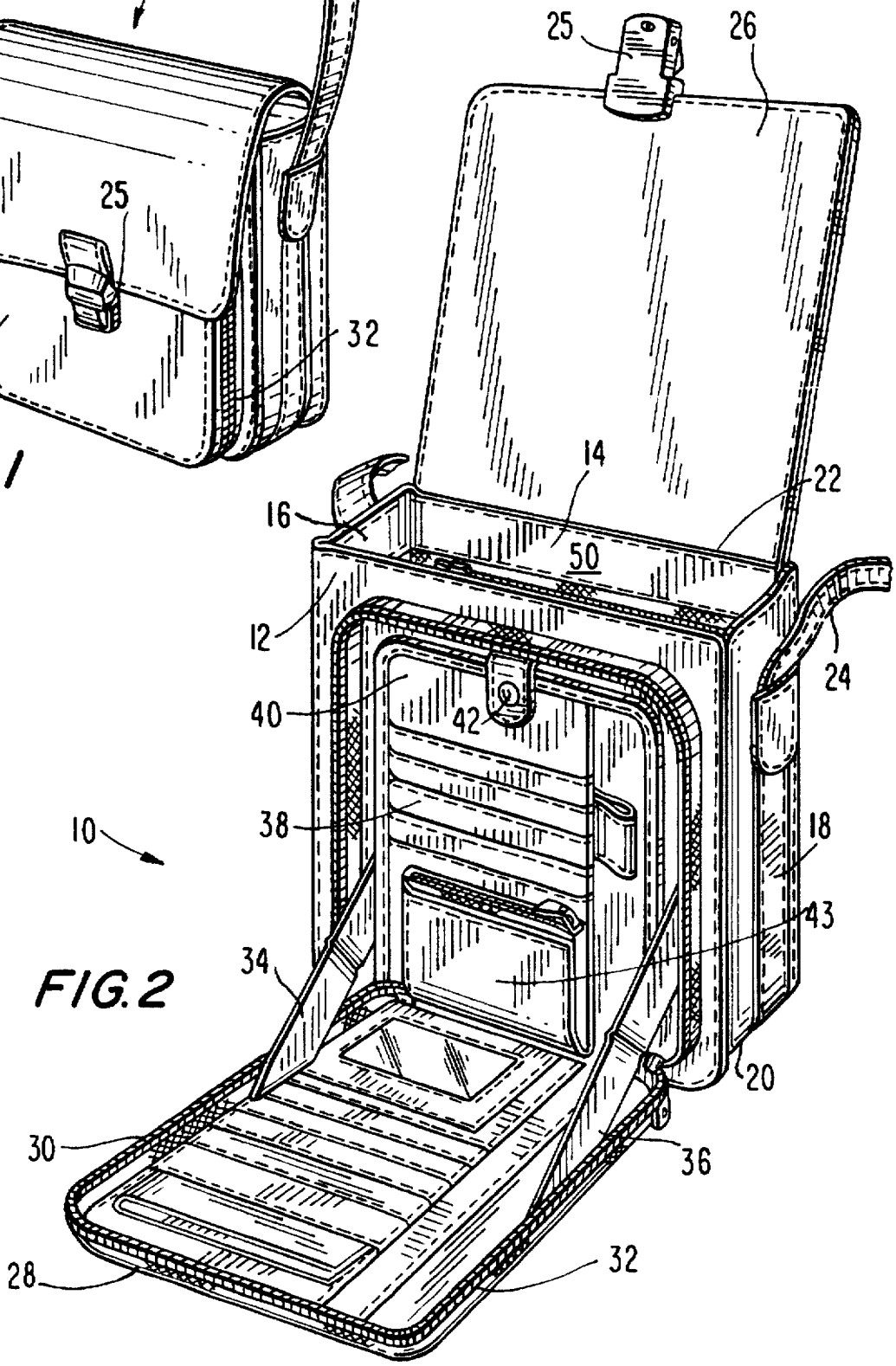
FIG. 2 is a perspective view of the handbag illustrated in FIG. 1 with the front cover panel opened to show the access panel and the top cover flap opened to show one of the storage regions defined within the interior of the handbag.

Referring to FIG. 2, handbag 10 defines an enclosure which includes a front wall 12, a rear wall 14, opposed side walls 16 and 18, and a bottom wall 20 opposite which an opening 22 is defined for gaining access from the top into the interior of the enclosure. Opposed ends of a shoulder strap 24 are secured to the opposed side walls 16 and 18 adjacent opening 22 for carrying the handbag. A cover flap 26 is hingedly connected to the rear wall 14 along an upper edge thereof to selectively cover the opening 22 of handbag 10. A releasable fastening mechanism 25 is operatively associated with cover flap 26 and the front wall 12 of handbag 10 for selectively securing the cover flap in a closed and locked position. The fastening mechanism 25 may be a magnetic or snap-type closure mechanism. The handbag may be constructed of natural leather, synthetic leather, or vinyl, and the walls may be joined by stitching or other methods known in the art.

With continuing reference to FIG. 2, a closure panel 28 is hingedly connected to the front wall 12 of handbag 10 along a lower edge thereof. Closure panel 28 delimits an outer storage area within which selected items may be retained for ready access. More particularly, a plurality of pockets 30 are formed on the interior surface of closure panel 28 for holding such items as credit cards, pictures, paper money, or coins. A zipper type fastening mechanism 32 extends about the periphery of closure panel 28 and is operatively associated with the front wall 12 for releasably securing the cover panel in the closed position illustrated in FIG. 1. Lateral support struts 34 and 36 extend from the interior surface of closure panel 28 to front wall 12 to limit the range of movement of closure panel 28 when it is moved from the closed position of FIG. 1 to the open position illustrated in FIG. 2. Thus, when the handbag is held upright, closure panel 28 can be pivoted downwardly to a horizontal position as shown.

Access panel 40 is disposed within the storage area delimited by closure panel 28, and is hingedly connected to the front wall 12 of handbag 10 along a lower edge portion thereof. The exterior surface of access panel 40 is also provided with a plurality of pockets 38 similar to those provided on the interior surface of closure panel 28 for retaining selected items and a change purse 43 for retaining coins. Access panel 40 is secured in the closed position illustrated in FIG. 2, by a snap-type fastener 42 which is operatively associated with the front wall 12 of handbag 10. Other types of fastening mechanisms may also be employed. When fastener 42 is released, access panel 40 may be moved to an open position which is illustrated in FIG. 3.

Figure 3:
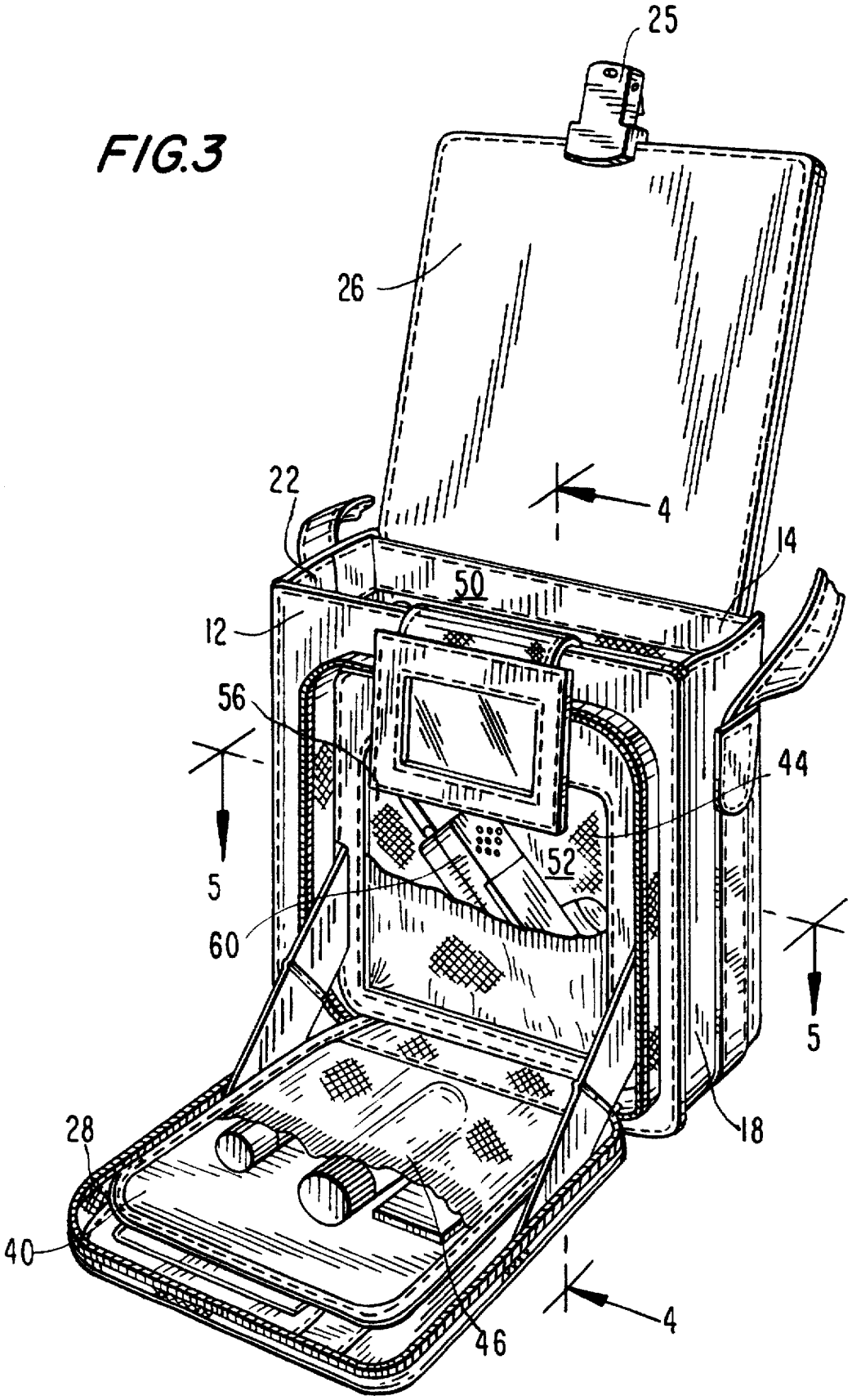
FIG. 3 is a perspective view of the handbag of FIG. 1 as shown in FIG. 2, with the pivoting access panel disposed in an open position to reveal the interior storage region covered thereby.
Figure 4:
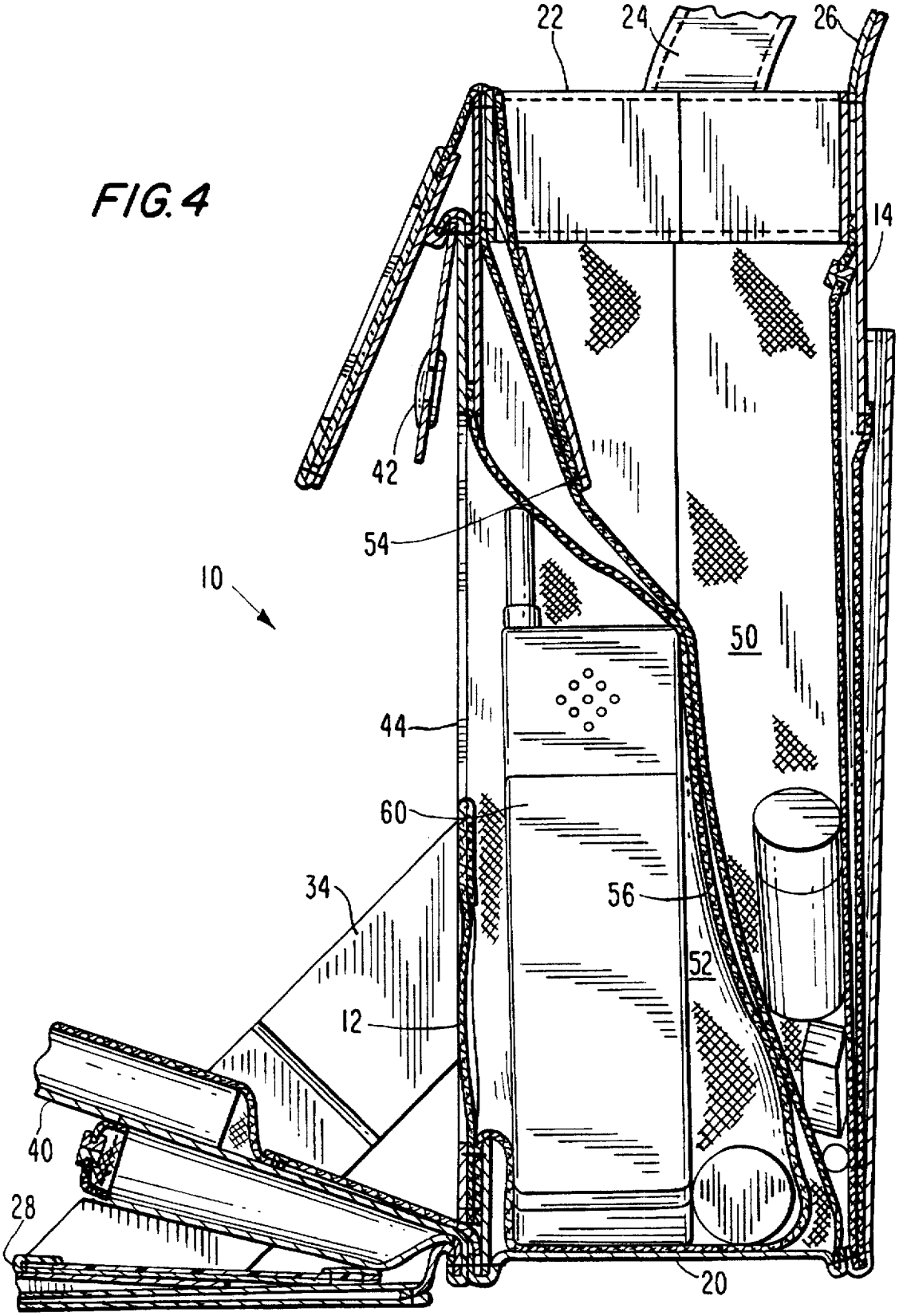
FIG. 4 is an enlarged cross-sectional view of the handbag taken along lines 4—4 of FIG. 3 and illustrating the two separated storage regions defined within the interior of the handbag from a side profile.

Referring now to FIG. 3, with access panel 40 disposed in an open position, a portal 44 formed in the front wall 12 of handbag 10 is revealed, as are additional pockets 46 provided on the interior surface of the access panel. Portal 44 defines an entryway into one of the two storage regions formed within the interior of handbag 10. More particularly, as illustrated in FIG. 4, the interior storage space of handbag 10 is divided into two incommunicable storage regions 50 and 52 which are separated from one another by a fabric curtain wall 54 that transects the interior storage space. Storage region 50 (the primary storage area) is accessible through the top opening 22 of handbag 10, while storage region 52 is accessible only through the portal 44 formed in the front wall 12 of the handbag. It is envisioned that the portal can be formed in the front wall, the rear wall, or either of the side walls, depending upon the particular style of the handbag.

Figure 5:
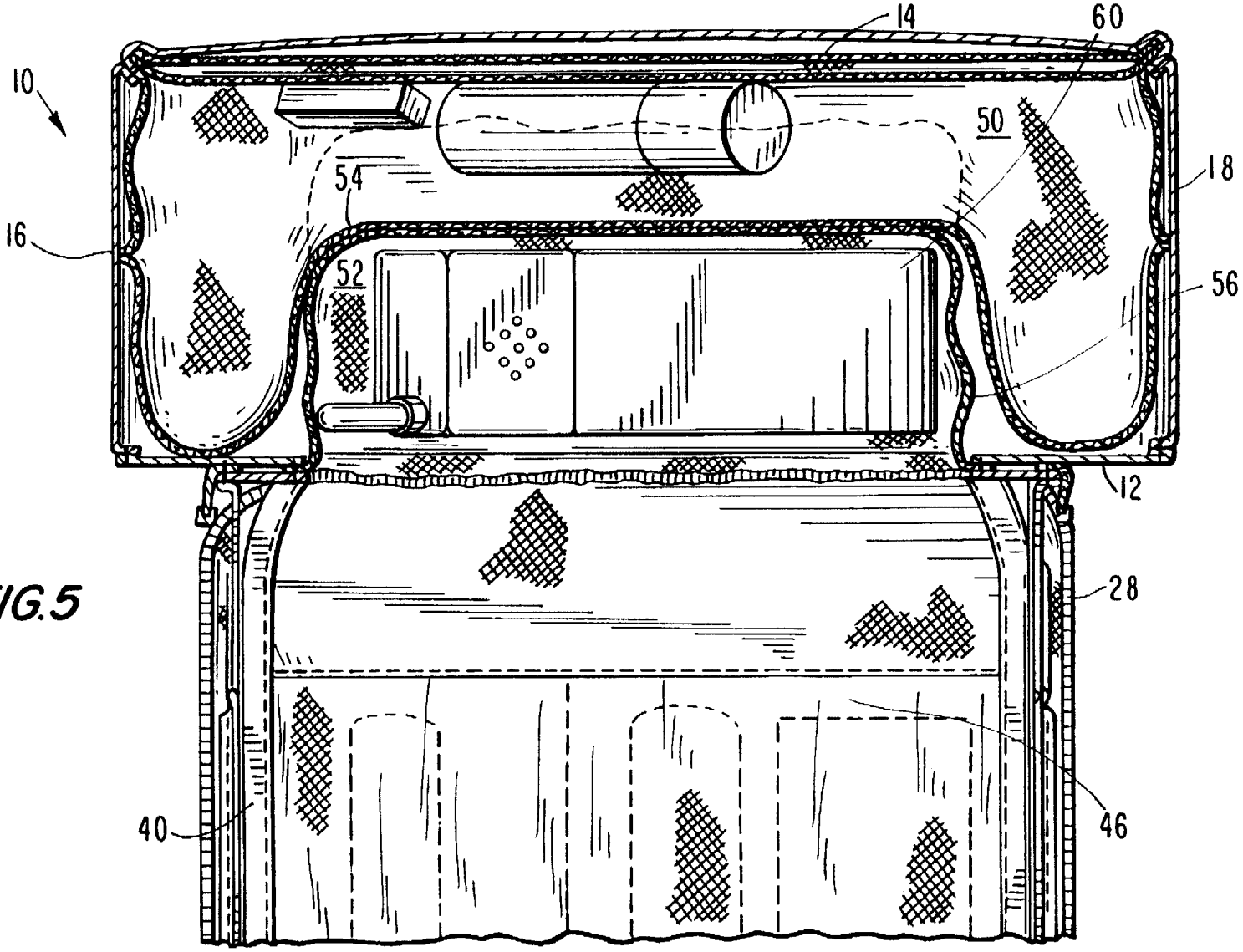
FIG. 5 is a cross-sectional view of the present handbag, taken along lines 5—5 of FIG. 3 and illustrating the two separated storage regions defined within the interior portion of the handbag from a top profile.

Curtain wall 54 shown in FIG. 4 preferably extends from the upper edge of front wall 12 to the lower edge of rear wall 14 to advantageously divide the interior space of the handbag. As shown in FIG. 5, curtain wall 54 is also secured to the side walls 14 and 16 of handbag 10 in a centralized location. A fabric liner 56 occupies storage region 52 and forms a pouch within which selected items of value may be retained, such as, for example, the portable telephone 60 illustrated in FIGS. 3–5. Items retained within storage region 52 can only be accessed through portal 44. Thus, if access panel 40 is in a closed, securely fastened position, portal 44 and the contents of storage region 52 will remain concealed from persons other than the user of the handbag. Moreover, if someone should gain unauthorized access into storage region 50 through the opening 22 of handbag 10, for example, a purse snatcher or pickpocket, the valued contents of storage region 52 will remain inaccessible to such person.

Figure 6:
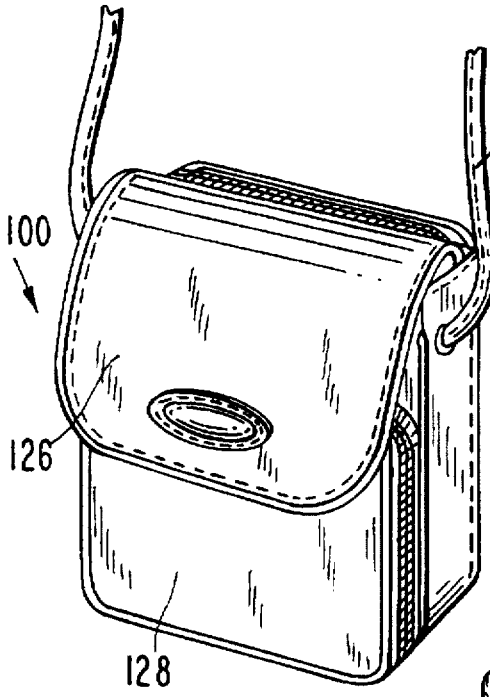
FIG. 6 is a perspective view of another handbag constructed in accordance with a preferred embodiment of the subject invention.
Figure 7:
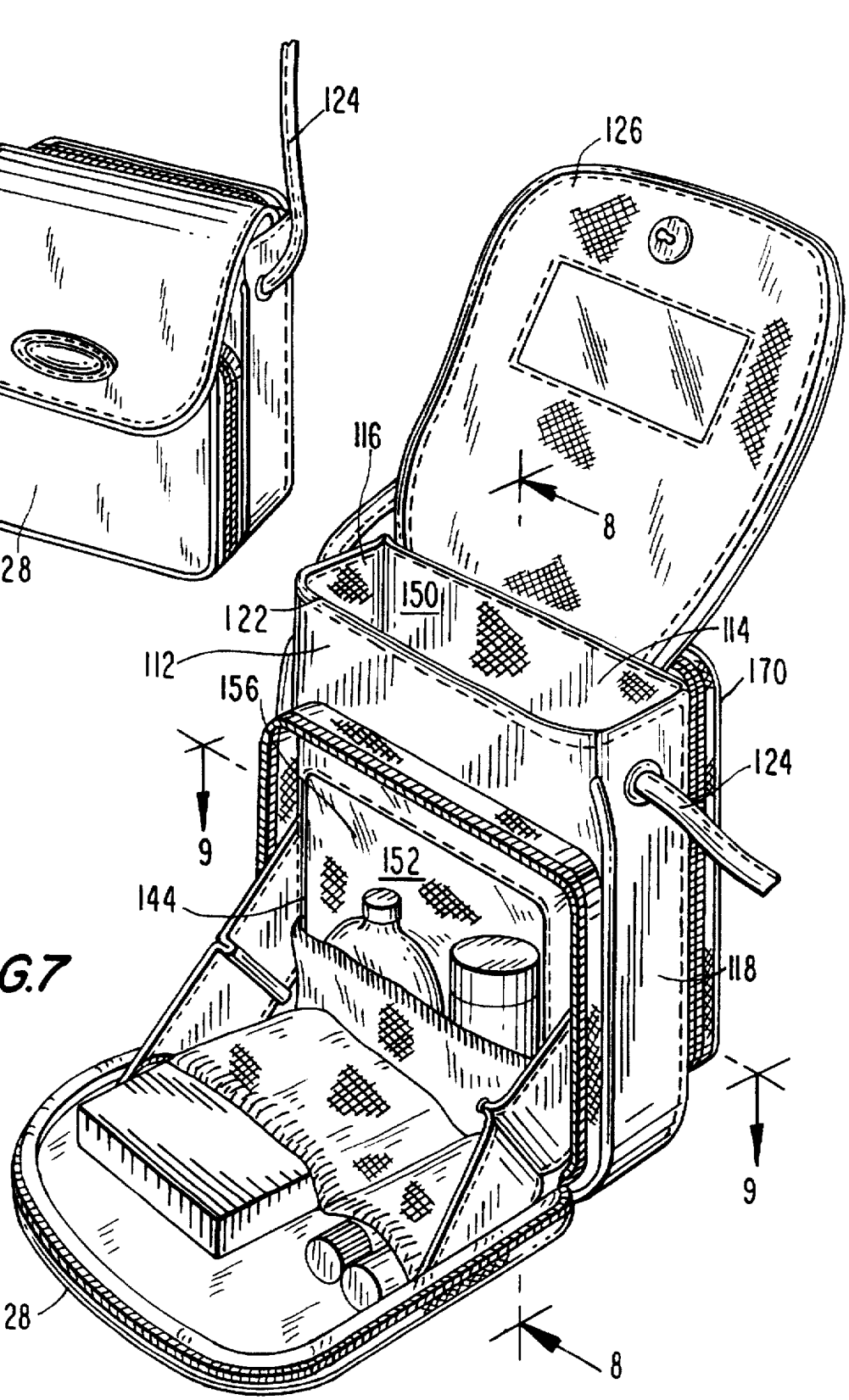
FIG. 7 is a perspective view of the handbag illustrated in FIG. 6, with the front cover panel opened to reveal the area covered thereby including one of the storage areas defined within the interior of the handbag, and with the top cover panel opened to show the other of the two storage areas defined within the interior portion of the handbag.

Referring now to FIGS. 6 and 7, there is illustrated another handbag constructed in accordance with a preferred embodiment of the subject invention and designated generally by reference numeral 100. Handbag 100 is constructed in a manner which is substantially similar to the construction of handbag 10 described hereinabove, in that the interior of the enclosure is divided into two incommunicable storage regions which are accessible through respective entryways or openings formed in the handbag.

As best seen in FIG. 7, handbag 100 includes a front wall 112, a rear wall 114, opposed side walls 116 and 118, and a bottom wall 120 opposite which the opening 122 of handbag 100 is defined. A shoulder strap 124 and cover flap 126 are provided for carrying and closing the handbag, respectively. As in handbag 10 described previously, a closure panel 128 is hingedly connected to the front wall 112 of handbag 100 for covering the portal 144 formed therein. Unlike handbag 10 however, the portal 144 formed in the front wall is not concealed by an access panel. Thus, access into storage region 152 may be acquired by moving closure panel 128 to the open position illustrated in FIG. 7. Access into storage region 150, best seen in FIG. 8, is acquired through the opening 122 of handbag 100.

Figure 8:
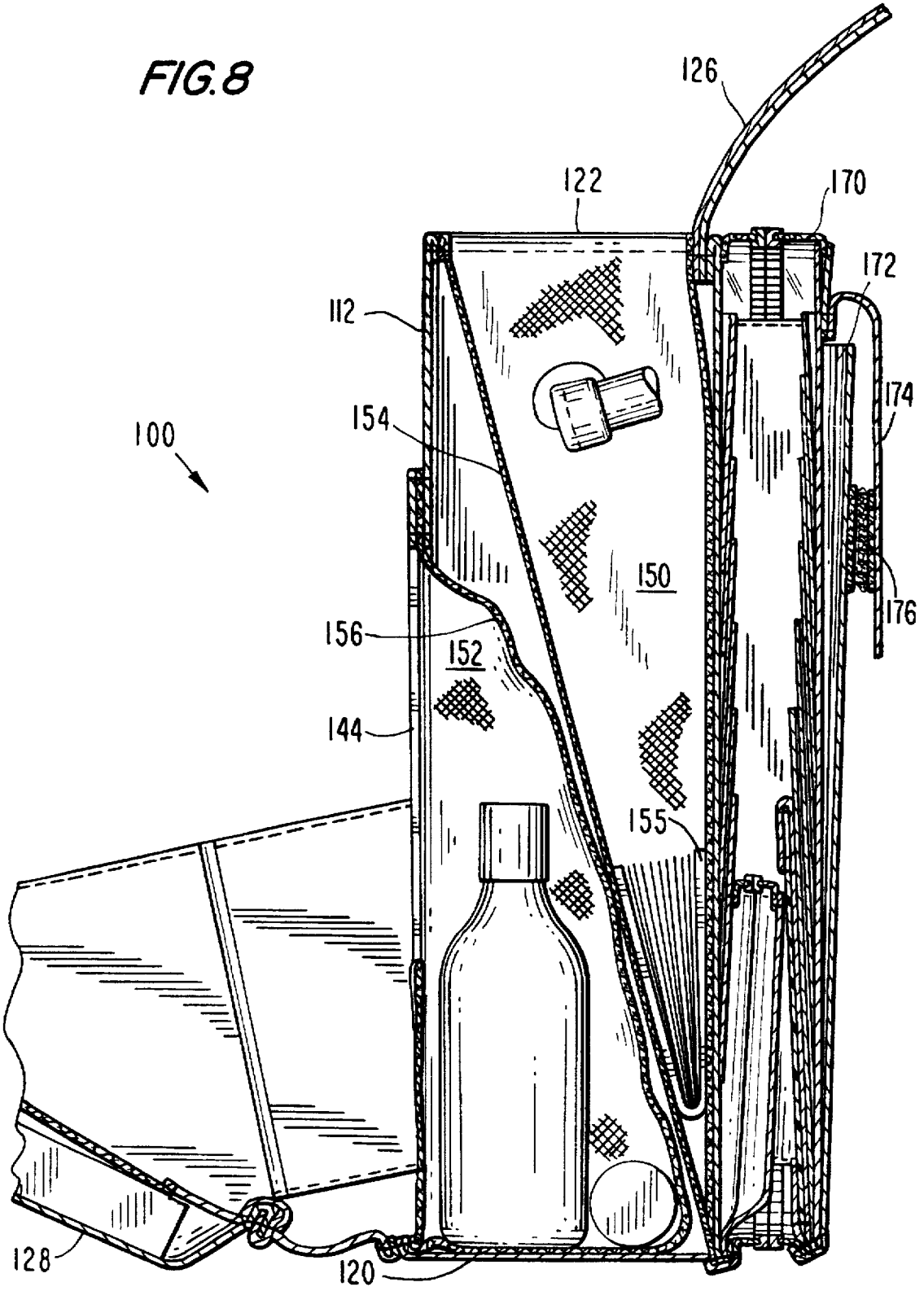
FIG. 8 is a cross-sectional view of the handbag taken along lines 8—8 of FIG. 7 and illustrating the two separated storage regions defined within the interior of the handbag.

With continuing reference to FIG. 8, the two storage regions defined within the enclosure of handbag 100 are separated, and isolated from one another, by a fabric curtain wall 154 which extends from the upper edge of front wall 112 to the lower edge of rear wall 114. Curtain wall 154 is also secured to the side walls 116 and 118 of handbag 100 along the junction seam which exists between the rear wall 114 and each of the side walls. A biasing member 155 is disposed between curtain wall 154 and the rear wall 114 of handbag 100 for maintaining the structural integrity and shape of storage region 150. As in handbag 100, a fabric liner 156 occupies storage region 152 for supporting items introduced through portal 144.

Figure 9:
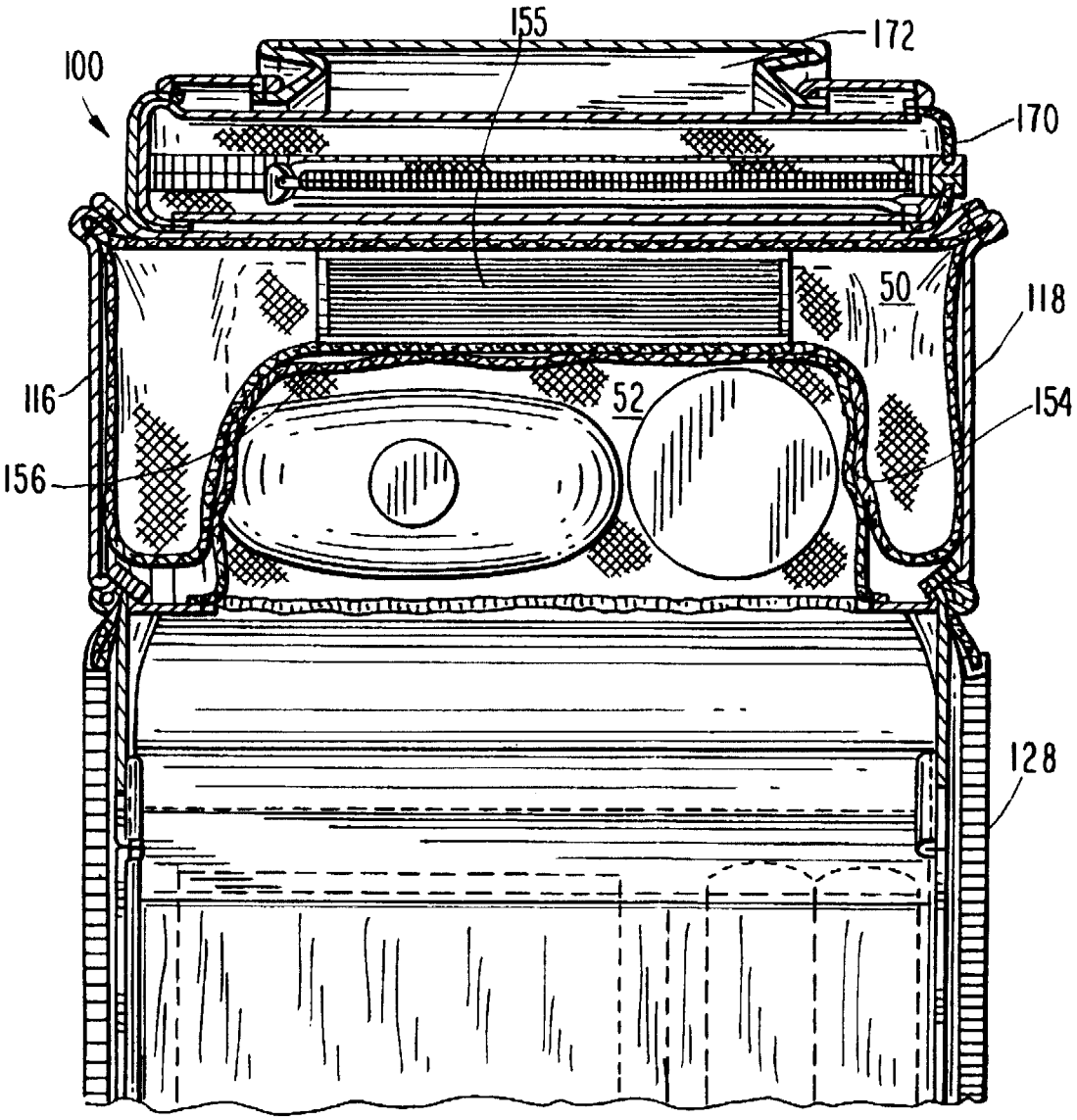
FIG. 9 is a cross-sectional view of the handbag taken along lines 9—9 of FIG. 7 and illustrating the two separated storage regions defined within the interior of the handbag from a top profile.

Handbag 100 also includes a second closure panel 170 hingedly connected to a lower edge portion of rear panel 114. Closure panel 170 encloses a containment area within which selected items may be retained for ready access. A conventional fastening mechanism, such as a zipper, extends about the periphery of closure panel 170 for selectively maintaining the panel in the closed position illustrated in FIGS. 8 and 9. An additional containment pouch 172 having a closure flap 174 associated therewith is provided on the exterior surface of closure panel 170. A hook and loop type fastener 176 is operatively associated with closure flap 174 and the exterior surface of panel 170 for selectively maintaining the flap in a closed position. As discussed hereinabove, the portal may be formed in either the front or rear wall of the handbag.

Referring now to FIGS. 10 and 11, there are illustrated two additional handbags constructed in accordance with a preferred embodiment of the subject invention and designated generally by reference numerals 200 and 300, respectively. Handbag 200 includes an elongated compartment 210 which is accessible through a structured portal 212 formed in one of the side walls thereof which has a closure flap 216. Compartment 210 is dimensioned and configured to support elongated objects, such as, for example, collapsible umbrella 215. As illustrated in FIG. 10, the material curtain wall 218 which separates compartment 210 from the remainder of the interior of handbag 200 substantially occupies the area which defines compartment 210 when there are no objects contained therein, thereby maximizing the useful storage space within the remaining compartments of the handbag. Turning to FIG. 11, handbag 300 includes a compartment 310 which is accessible through a structured portal 312 formed in one of the side walls of the handbag for storing small often used objects, such as, for example, eyeglasses 315. A closure flap 316 is operatively associated with the structured portal of compartment 310 for securing the contents thereof.

Referring to FIGS. 12–14, another handbag constructed in accordance with a preferred embodiment of the subject invention is illustrated and is designated generally by reference numeral 400. Handbag 400 includes a plurality of separate storage compartments (i.e. storage compartments **410*a*–410*e*) each having a respective closure flap (i.e. closure flaps 416*a*–416*e*). Curtain walls 418*a*–418*d* separate and define the individual storage compartments of handbag 100. The curtain walls are supported within the interior of handbag 400 in a loosely draped manner as best seen in FIG. 13**, and are dimensioned to permit selective expansion and reduction of each of the individual storage compartments in dependance upon the shape and/or dimension of the objects contained therein.

Although the subject invention has been described with respect to preferred embodiments, it will be readily apparent to those having ordinary skill in the art to which it appertains that changes and modifications may be made thereto without departing from the spirit or scope of the subject invention as defined by the appended claims.

What is claimed is:

1. A handbag which comprises an enclosure having opposed front and rear walls, opposed side walls, a bottom wall, and an opening for providing access into an interior storage space of the enclosure, the interior storage space being subdivided into at least first and second storage regions, the first storage region being accessible through said opening for storing objects therein through said opening, and the second storage region being accessible for storing objects therein through a portal formed in at least one of said walls, a closure panel extending over said portal and being movable from a first position wherein said portal is covered, to a second position wherein said portal is exposed to provide access to said second storage region, and an access panel associated with said at least one wall and movable between a first position which covers said closure panel to a second position which exposes said closure panel, said access panel being smaller along at least one dimension than said at least one wall.

2. A handbag as recited in claim 1, wherein said closure panel comprises a hinged panel operatively associated with the wall having said portal formed therein for covering said portal and adapted for securement in a closed position by a releasable fastening mechanism.

3. A handbag as recited in claim 2, wherein said access panel is hinged and mounted for selective movement between a closed position wherein the portal is concealed and an open position wherein access to the second storage region is facilitated.

4. A handbag as recited in claim 2, wherein said closure panel includes at least one pocket to support objects for ready access.

5. A handbag as recited in claim 3, wherein said access panel includes at least one pocket to support objects for ready access.

6. A handbag as recited in claim 3, wherein a releasable fastening mechanism is operatively associated with said access panel to selectively maintain said access panel in the closed position.

7. A handbag as recited in claim 1, wherein the first and second storage regions defined within the interior of the enclosure are separated by a curtain wall.

8. A handbag as recited in claim 7, wherein the curtain wall is dimensioned and loosely draped to permit selective expansion and reduction of either of said storage regions in dependance upon the contents thereof.

9. A handbag as recited in claim 7, wherein the curtain wall extends from an upper edge portion of the front wall to a lower edge portion of the rear wall within the interior storage space of the enclosure, and is secured to the opposed side walls.

10. A handbag as recited in claim 1, further comprising a hinged closure flap associated with an upper portion of at least one of said walls to selectively cover the opening, the closure flap being securable in a closed position by a releasable fastening mechanism associated therewith.

11. A handbag as recited in claim 3, further comprising a second hinged closure panel operatively associated with the wall opposite the wall within which the portal is formed and secured in a closed position by a releasable fastening mechanism.

12. A handbag which comprises an enclosure having opposed front and rear walls, opposed side walls, a bottom wall, and an opening defined opposite the bottom wall for providing access into an interior storage space of the enclosure, the interior storage space being subdivided into first and second incommunicable storage regions separated from one another by a curtain wall which transects the interior storage space, the first storage region being accessible through the opening, and the second storage region having a liner and being accessible through a portal formed in the front wall of the handbag.

13. A handbag as recited in claim 12, further comprising a hinged closure panel operatively associated with the front wall for covering the portal and adapted for securement in a closed position by a releasable fastening mechanism.

14. A handbag as recited in claim 13, further comprising a hinged access panel supported adjacent the closure panel and mounted for selective movement between a closed position wherein the closure panel and the portal is concealed and an open position wherein access to the closure panel and the second storage region is facilitated.

15. A handbag as recited in claim 14, wherein a releasable fastening mechanism is operatively associated with the access panel to selectively maintain the access panel in the closed position.

16. A handbag as recited in claim 12, wherein the curtain wall extends from an upper edge portion of the front wall to a lower edge portion of the rear wall within the interior storage space of the enclosure, and is secured to the opposed side walls.

17. A handbag as recited in claim 12, further comprising a hinged closure flap associated with an upper portion of one of the walls for selectively covering the opening, the closure flap being secured in a closed position by a releasable fastening mechanism associated with the closure flap.

18. A handbag as recited in claim 13, further comprising a second hinged closure panel operatively associated with the rear wall and adapted for securement in a closed position by a releasable fastening mechanism.

19. A handbag which comprises an enclosure having opposed front and rear walls, opposed side walls, a bottom wall, and an opening defined opposite the bottom wall for providing access into an interior storage space of the enclosure, the interior storage space being subdivided into at least first and second incommunicable storage regions, the first storage region being accessible through the opening, and the second storage region having a liner and being accessible through a portal formed in the front wall, the handbag further comprising a hinged closure panel operatively associated with the front wall for covering the portal, and a hinged access panel supported adjacent the closure panel and mounted for selective movement between a closed position wherein the portal is concealed and an open position wherein access to the second storage region is facilitated.

20. A handbag as recited in claim 19, wherein the hinged closure panel is adapted for securement in a closed position by a releasable fastening mechanism.

21. A handbag as recited in claim 17, wherein the first and second storage regions are separated by a loosely draped fabric curtain wall which transects the interior storage space of the handbag and facilitates selective expansion and reduction of either of the storage regions in dependance upon the contents thereof.

22. A handbag which comprises an enclosure having opposed front and rear walls, opposed side walls, a bottom wall, and an opening for providing access into an interior storage space of the enclosure, the interior storage space being subdivided into at least first and second storage regions, the first storage region being accessible through said opening, and the second storage region having a liner and being accessible through a portal formed in at least one of said walls.

23. A handbag which comprises an enclosure having opposed front and rear walls, opposed side walls, a bottom wall, and an opening for providing access into an interior storage space of the enclosure, the interior storage space being subdivided by a curtain wall into at least first and second storage regions, said curtain wall extending from an upper edge portion of the front wall to a lower edge portion of the rear wall within the interior storage space of the enclosure, and being secured to the opposed side walls of the handbag.

24. A handbag which comprises an enclosure having opposed front and rear walls, opposed side walls, a bottom wall, and an opening defined opposite the bottom wall for providing access into an interior storage space of the enclosure, the interior storage space being subdivided into first and second incommunicable storage regions separated from one another by a curtain wall which transects the interior storage space, said curtain wall extending from an upper edge portion of the rear wall within the interior storage space of the enclosure, and being secured to the opposed side walls, the first storage region being accessible through the opening, and the second storage region being accessible through a portal formed in the front wall.

* * * * *

UNITED STATES PATENT AND TRADEMARK OFFICE

CERTIFICATE OF CORRECTION

PATENT NO. : 5,749,447

DATED : May 12, 1998

INVENTOR(S) : Hersh et al.

It is certified that error appears in the above-identified patent and that said Letters Patent is hereby corrected as shown below:

Column 6, line 46, change "a closure" to -- an access --;

Column 6, lines 49-50, change "an access" to -- a closure --;

Column 6, line 51, change "closure" to -- access --

Column 6, line 52, change "closure" to -- access --;

Column 6, line 53, change "access" to -- closure --;

Column 6, line 55, change "closure" to -- access --;

UNITED STATES PATENT AND TRADEMARK OFFICE

CERTIFICATE OF CORRECTION

PATENT NO. :5,749,447

DATED :May 12,1998

INVENTOR(S) :Hersh et al.

It is certified that error appears in the above-identified patent and that said Letters Patent is hereby corrected as shown below:

Column 6, line 60, change "access" to -- closure --;

Column 7, line 46, change "access" to -- closure --;

Column 7, line 46, change "closure" to --access --;

Column 7, line 48, change "closure" to -- access --;

Column 7, line 49, change "closure" to -- access --;

Signed and Sealed this

Twenty-ninth Day of June, 1999

*Attest:*

Q. TODD DICKINSON

*Attesting Officer*

*Acting Commissioner of Patents and Trademarks*

US005749447C1

(12) REEXAMINATION CERTIFICATE (4799th)

United States Patent

Hersh et al.

(10) Number: US 5,749,447 C1

(45) Certificate Issued: Jun. 24, 2003

(54) HANDBAG HAVING COMPARTMENTALIZED STORAGE AREA

(75) Inventors: Ahron Hersh, Brooklyn, NY (US); Yueh Chen, Taipei (TW)

(73) Assignee: Rosetti Handbags and Accessories Ltd., New York, NY (US)

Reexamination Request:
No. 90/005,946, Mar. 2, 2001

Reexamination Certificate for:

| | |
|---|---|
| Patent No.: | **5,749,447** |
| Issued: | **May 12, 1998** |
| Appl. No.: | **08/504,995** |
| Filed: | **Jul. 20, 1995** |

Certificate of Correction issued Jun. 29, 1999.

(51) Int. Cl.[7] ..... A45C 3/06

(52) U.S. Cl. ..... 190/112; 190/111

(58) Field of Search ..... 180/101, 117; 190/111, 112; 383/38, 40, 41

(56) References Cited

U.S. PATENT DOCUMENTS

| | | | | |
|---|---|---|---|---|
| 1,285,452 | A | | 11/1918 | Steinman |
| 1,790,497 | A | | 1/1931 | Brady |
| 1,793,899 | A | | 2/1931 | Benforado |
| 1,828,342 | A | | 10/1931 | Sachs |
| 1,841,154 | A | | 1/1932 | Rath |
| 2,025,101 | A | | 12/1935 | Halpin |
| D106,446 | S | | 10/1937 | Laufman |
| 2,164,493 | A | | 7/1939 | Branen |
| D116,165 | S | | 10/1939 | Kaufman |
| 2,331,428 | A | | 10/1943 | Selezneff |
| 2,418,589 | A | | 4/1947 | Lifton |
| 2,481,565 | A | | 9/1949 | Boretz |
| 2,533,850 | A | * | 12/1950 | Syracuse |
| 2,597,194 | A | | 5/1952 | Sholl |
| 2,665,728 | A | | 1/1954 | Hyman |
| 2,705,989 | A | | 4/1955 | Gusmarino |
| 2,717,015 | A | | 9/1955 | Berry |
| 2,802,501 | A | | 8/1957 | Stember |
| 2,851,076 | A | | 9/1958 | Stakofsky |
| 2,855,969 | A | | 10/1958 | Shields |
| 3,117,607 | A | | 1/1964 | Siegel |
| 4,171,011 | A | | 10/1979 | Kopin |
| 4,236,615 | A | | 12/1980 | Ginat |
| 4,301,849 | A | | 11/1981 | Litwack et al. |
| 4,354,542 | A | * | 10/1982 | Gerch |
| 4,378,866 | A | | 4/1983 | Pelavin |
| 4,739,809 | A | | 4/1988 | Adams |
| 4,782,874 | A | * | 11/1988 | Chartier |
| 4,805,749 | A | | 2/1989 | Gerch |
| 4,830,154 | A | | 5/1989 | Gerch et al. |
| 4,941,603 | A | * | 7/1990 | Creamer |
| 4,995,436 | A | | 2/1991 | Cantor |
| 5,265,719 | A | | 11/1993 | Wand |
| 5,427,453 | A | * | 6/1995 | Cloessner |

FOREIGN PATENT DOCUMENTS

| | | |
|---|---|---|
| DE | 553428 | 6/1932 |

* cited by examiner

*Primary Examiner*—Stephen K. Cronin

(57) ABSTRACT

A handbag is disclosed which includes an enclosure having opposed front and rear walls, opposed side walls, a bottom wall, and an opening defined opposite the bottom wall for gaining access into an interior area of the enclosure. The interior area of the enclosure is subdivided into first and second incommunicable storage regions separated from one another by a curtain wall. The first storage region is accessible through the opening of the handbag, and the second storage region is accessible through a structural portal formed in the front wall of the handbag.

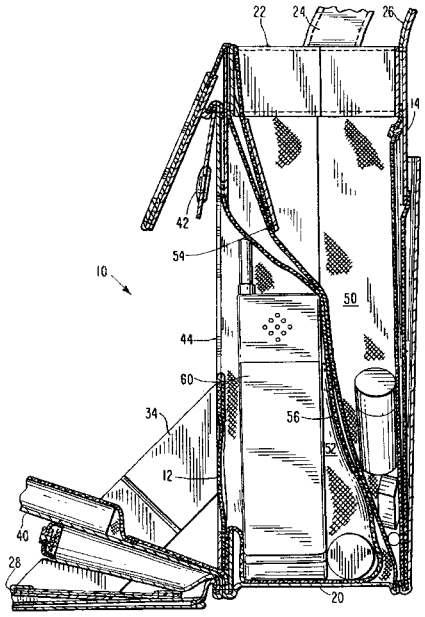

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 12–24 are cancelled.

Claim 1 is determined to be patentable as amended.

Claims 2–11, dependent on an amended claim, are determined to be patentable.

1. A handbag which comprises an enclosure having opposed front and rear walls, opposed side walls, a bottom wall, and an opening for providing access into an interior storage space of the enclosure, the interior storage space being subdivided into at least first and second storage regions, the first storage region being accessible through said opening for storing objects therein through said opening, and the second storage region being accessible for storing objects therein through a portal formed in at least one of said walls, an access panel extending over said portal and being movable from a first position wherein said portal is covered, to a second position wherein said portal is exposed to provide access to said second storage region, and a closure panel associated with said at least one wall and movable between a first position which covers said access panel [to] *and* a second position which exposes said access panel, said closure panel being smaller along at least one *of a height dimension and a width* dimension *of said closure panel* than *a corresponding height dimension and width dimension of* said at least one wall.

* * * * *